US006082710A

United States Patent [19]

Dragsund et al.

[11] Patent Number: 6,082,710

[45] Date of Patent: Jul. 4, 2000

[54] DEVICE FOR THE RETRIEVAL OF OCEAN BOTTOM SEISMIC CABLE

[75] Inventors: Inge Dragsund, Ulsteinvik; Bård Rune Kvalsund, Fosnavåg, both of Norway

[73] Assignee: Odim Holding A/S, Ulsteinvik, Norway

[21] Appl. No.: 08/967,980

[22] Filed: Nov. 12, 1997

[30] Foreign Application Priority Data

Nov. 12, 1996 [NO] Norway ..... 964790

[51] Int. Cl.[7] ..... B65H 54/00

[52] U.S. Cl. ..... 254/134; 254/265

[58] Field of Search ..... 367/19; 254/134.35 C, 254/134.3, 265; 242/54 R; B65H 59/00; B63B 35/03

[56] References Cited

U.S. PATENT DOCUMENTS 5,199,659 4/1993 Zibilich, Jr. ..... 242/54 R 5,284,323 2/1994 Pawkett ..... 254/134.3 SC

FOREIGN PATENT DOCUMENTS 1 107 311 5/1961 Germany .

52753 7/1933 Norway .

*Primary Examiner*—Christine K. Oda

*Assistant Examiner*—Anthony Jolly

*Attorney, Agent, or Firm*—Pillsbury Madison & Sutro

[57] ABSTRACT

A device for retrieving ocean bottom seismic cable as the cable is pulled up from the bottom and hauled aboard a vessel. The cable is first led over a front wheel located on an arm which is pivotally mounted for movement about an axis. The cable is then passed under a second wheel before it is brought aboard the vessel, optionally via one or more additional wheels. A damper is provided between a fixed point on the arm, spaced apart from the axis and a fixed point on the vessel, so that the front wheel is raised in response to lower tension in the cable and is lowered in response to an increase in tension in the cable, thereby counteracting any variations in the tension of the cable.

6 Claims, 2 Drawing Sheets

DEVICE FOR THE RETRIEVAL OF OCEAN BOTTOM SEISMIC CABLE

BACKGROUND OF THE INVENTION

The present invention relates to the handling of ocean bottom seismic cable, more specific the invention relates to a device for the retrieval of the cable from the ocean floor.

Seismic investigations at sea are usually carried out by using a surface seismic investigating apparatus and method where a seismic cable with monitoring equipment is towed behind a vessel, where, for example, air is "shot" into the water and forms sound waves which are reflected by the layers in the underlying rock formation, and where these reflections are registered by means of the monitoring equipment of the seismic cable.

Computer analyses of the registered pattern of reflections provide a basis for mapping structures of interest below the ocean floor.

Ocean bottom seismic investigating apparatus and method bear a strong resemblance to surface seismic investigating apparatus and method, with the exception that the monitoring cables are positioned on the ocean floor. Colloquially, seismic investigating apparatus and method are referred to by the shortened term "seismic," which is used for that meaning in this document, so that the monitoring equipment is in direct contact with the floor. The advantage of ocean bottom seismic is that by direct contact between the underlying floor and the monitoring equipment the sensitivity of the equipment is increased, and the measurements obtained are more accurate and detailed, giving the basis for a even more detailed mapping of the underlying structures. However, ocean bottom seismic is more expensive to carry out than surface seismic.

Typically, an ocean bottom seismic cable is 10 to 12 km in length and is composed of a plurality of sections of about 300 m in length fitted together using a connecting piece, and where the monitoring equipment which is to record signals from the ocean floor is placed at defined positions on the cable.

The cable can be laid on the ocean floor by being released from the stem of a vessel travelling at a speed of 2 to 5 knots across the ocean floor, upon which the monitoring cable is to be placed. During the registration of ocean bottom seismic, a plurality of cables are laid in parallel relation and spaced apart at a given distance on the ocean floor. Normally, the work will be carried out continuously so that two to four cables are used for monitoring, while the monitoring field is moved across the ocean floor by taking up the cable which lies outermost in the monitoring field, and moving this cable parallel with the other cables across to the other side of the monitoring field. During an operation of this kind three vessels are normally involved, one vessel which "shoots" and two vessels which alternate between monitoring the laid cables and moving the monitoring field by taking up a cable along one side edge of the field and moving across to the other side edge thereof.

Today, the ocean bottom seismic cable is retrieved by running the cable over a wheel which is located on the side at the front of the vessel. The cable is led over a wheel and in between a powered rubber wheel which ensures that the cable is passed abaft on the boat in a groove to the stem, where a block, suspended in a travelling crane lays the cable out across the deck so as to facilitate the location of the specific read-off points and the connecting pieces. The cable thus lies like a "heap of spaghetti" on the deck, where only the read-off points and the connecting pieces are accessible for measurement. En route to and from the survey, there may be two to three such cables lying on top of one another on a deck of a vessel of this kind.

A major and costly problem in connection with such ocean bottom seismic is that the cable tends to incur some damage, and much time is spent repairing this. This repair work is usually carried out by locating the fault through measurements at the defined read-off points and then replacing one or more sections.

Studies have also shown that about 50% of the damage to the cable takes place on board the boat during retrieval and deployment. During the retrieval of the cable, the cable is damaged because of jerks and uneven pull on the cable during the retrieval thereof. Normally, the cable runs, as mentioned above, over a wheel at the front on the side of the vessel. This wheel is fixed and follows the motions of the vessel, so that in rough seas there will be jerks on the cable. Moreover, the cable must run straight up from the ocean bottom, so that there is no tension in any direction along the ocean bottom, as this could cause the cable to become caught on objects on the bottom.

SUMMARY OF THE INVENTION

The objective of the invention is thus to provide a solution to the aforementioned problem.

Thus, the present application relates to a device for retrieving an ocean bottom seismic cable, wherein the cable which is pulled up from the bottom and hauled aboard a vessel, is first led over a front wheel located on an arm, which arm is pivotally mounted for movement about an axis, and that the cable is then passed under a second wheel before it is brought aboard the vessel, optionally via one or more additional wheels, characterized in that between a fixed point on the arm spaced apart from the axis, and a fixed point on the vessel there is provided a damper so that the front wheel is raised in response to lower tension in the cable and is lowered in response to an increase in tension in the cable, thereby counteracting any variations in the tension of the cable.

The present device for retrieving ocean bottom seismic cable thus reduces or eliminates the jerks which would be made on the cable during retrieval because of the motion of the ship in the waves. Moreover, the wheels of the device are positioned so that they swing in the direction of the cable, thus minimizing the strain on the cable against the wheels.

BRIEF DESCRIPTION OF THE DRAWING

The present invention will now be described in more detail with reference to the attached drawings, wherein.

DETAILED DESCRIPTION

Figure 1:
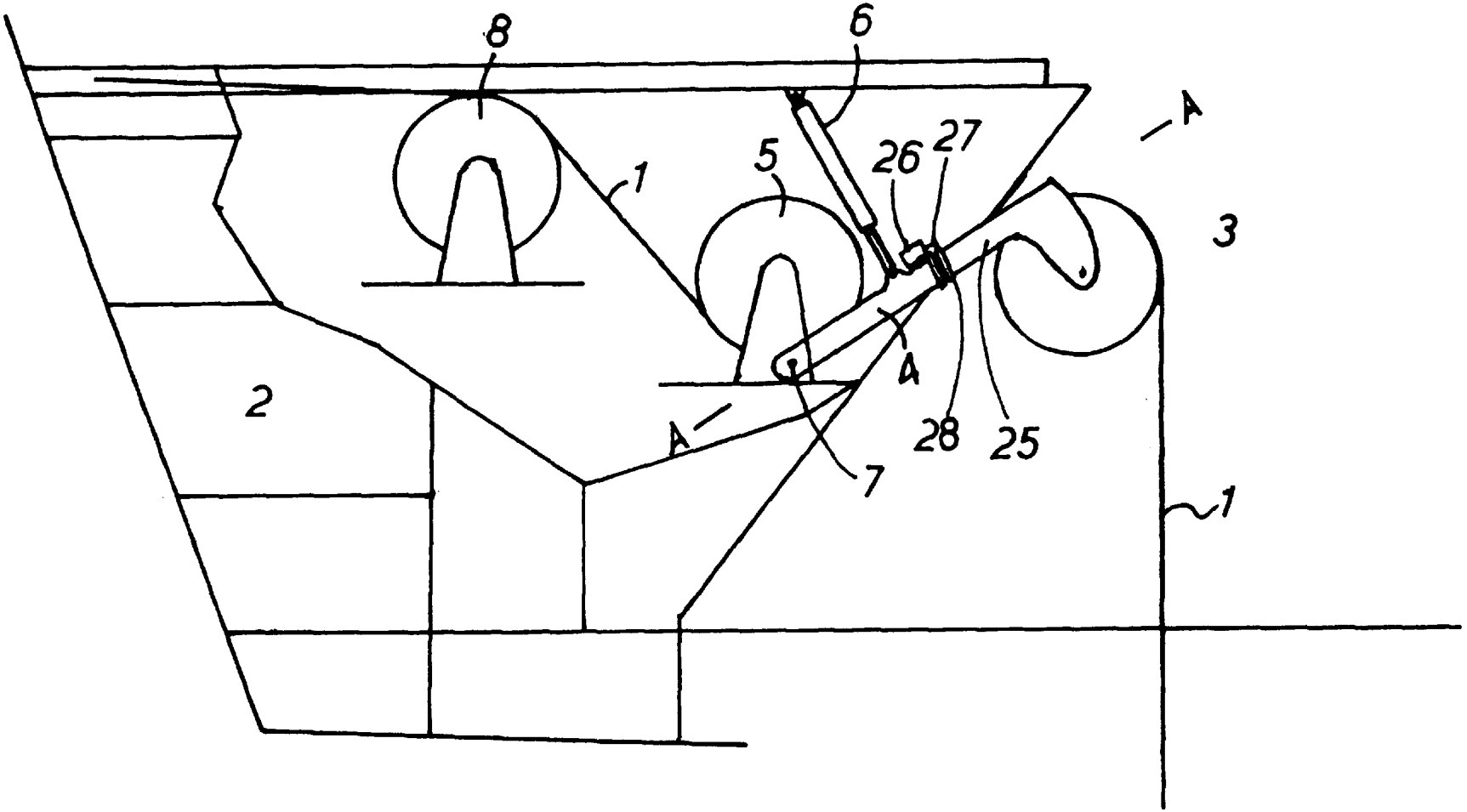
FIG. 1 is a skeleton drawing of an embodiment of a device for retrieving ocean bottom seismic cable.

When retrieving a cable 1 on board a vessel 2, the cable 1 runs as straight as possible up from the ocean floor over a wheel 3 suspended in a boom 4, 25 which is pivotally mounted about an axis 7. A hydraulic cylinder 6 is located between a fixed point on the boat 2 and the boom 4, so that the wheel 3 on the boom 4 is swung up when the force of the cable 1 is reduced in relation to the nominal force, i.e., the force which is the result of the weight of the cable hanging between the wheel 4 and the ocean floor, and which causes the wheel 3 to be lowered when the force of the cable increases in relation to the nominal force. Thus, the tensile strains to which the cable is exposed as the ship travels through the sea are eliminated or reduced, and also if the cable is accidentally caught in objects on the bottom. The cable 1 runs from wheel 3 down beneath a wheel 5. In a preferred embodiment, another wheel 8 is provided, over which the cable 1 is led before being dealt with for storage on board the vessel. The further movement of the cable 1 and the number of wheels which are necessary to guide the cable depend upon the structure of the vessel. However, it is essential that the embracing angle or contact face between the cable and each wheel be sufficiently great to ensure the friction necessary for a safe and fault-free advance of the cable. To ensure an even advance of the cable and to avoid overloading thereof, each wheel is powered and provided with tension control.

To ensure that the cable 1 is handled with care, it is of utmost importance that the cable 1 run straight onto the wheel 3. This can be accomplished in that the axis of wheel 3 is turned in response to the direction of the cable. The wheel 3 and the cable 1 are monitored preferably by sensors, and the wheel 3 is preferably actively adjusted according to the direction of the cable 1, as shown in FIG. 1.

In order to obtain control of the axis of the wheel 3, the boom 4, 25 is split so that the outer part 25 can turn about the longitudinal axis of the boom 4, 25 marked A—A on the figure. To this end, the outer part 25 is pivotally mounted in the inner part 4 of the arm. An active control of the turning of the outer arm 25 can be accomplished as shown in FIG. 1, in that a motor 26 is provided on the inner arm 4, where the motor 26 drives a toothed wheel 27 which is in engagement with a gear rim 28 on the outer arm 25. The turning of the outer arm 25 is then controlled in response to a signal from a detector which registers the direction of the cable 1 from the wheel 3 down into the sea.

The direction of the cable 1 and the wheel 3 preferably is read off on the bridge, so that this information is used to steer the ship.

Figure 2:
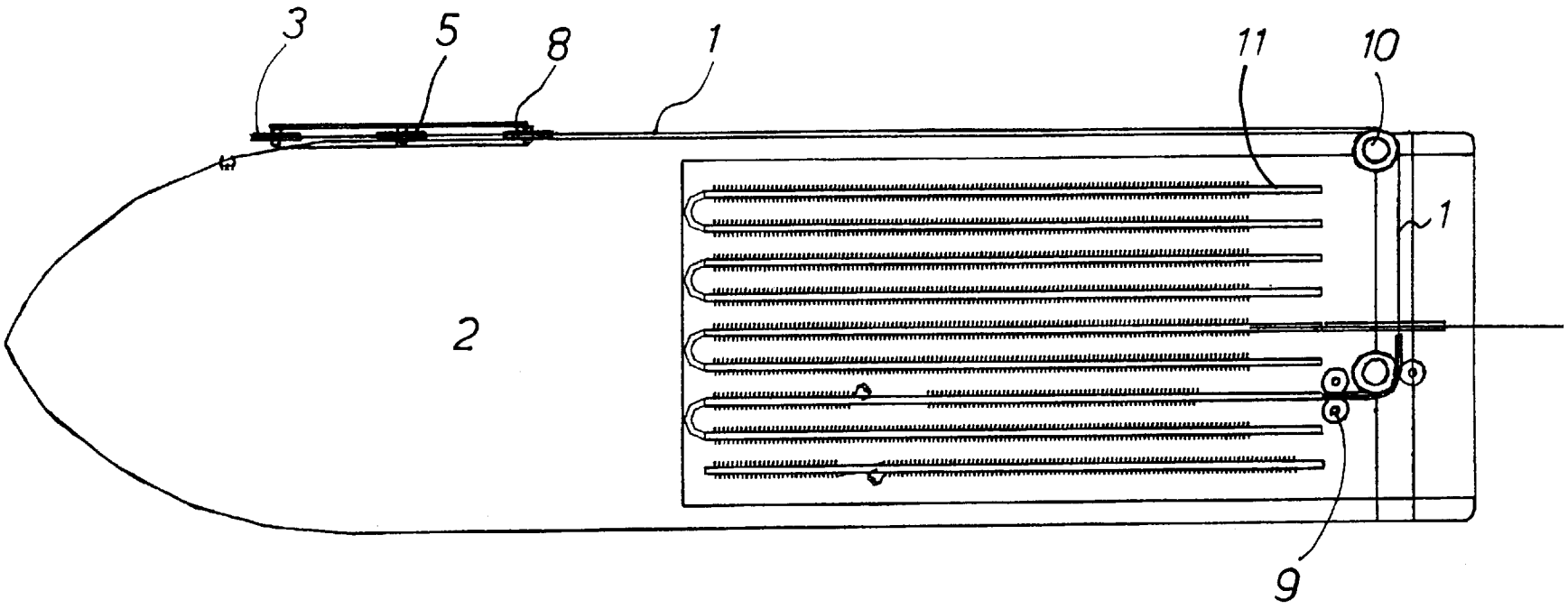
FIG. 2 is a bird's eye view of a vessel equipped with a device for the retrieval of cable and a device for storing the same.

Referring to FIG. 2, once the cable 1 has been brought on board the ship in the manner described above, the cable is fed by means of a powered guiding wheel 10 and /or groove (not shown) towards a cable storage device. FIG. 2 shows an example of a cable storage device of this kind, where the cable is led from the retrieving device to the stem of the ship, where the cable is pulled forward between two powered rubber wheels 9, and is then hung up on a storage device. All wheels for advancing the cable 1 are powered and have tension control to prevent excessive tension in the cable.

Having described our invention, we claim:

1. A device for retrieving an ocean bottom seismic cable onto a vessel which has a bow and a stern, comprising a boom arranged to be pivotally mounted at a rear end thereof to the vessel near the bow of the vessel, so that the boom, forwardly of said rear end, is pivotally movable up and down about a generally horizontal axis extending transversely of the boom;

a first wheel mounted on said boom forwardly of said rear end, for rotation about a substantially horizontal second axis which extends transversely of the boom;

a second wheel arranged to be mounted on said vessel for rotation about a substantially horizontal third axis; said first and second wheels being arranged such that a seismic cable being pulled directly up from the bottom of a body of water on which said vessel is afloat, passes first over said first wheel and second under said second wheel, on its way onto the vessel;

a damper having one end arranged to be mounted to the vessel and having a second end mounted to the boom at a location which is located forwardly of said horizontal axis; said damper being arranged to cause or allow said boom to pivot up and down about said horizontal axis in response to decreases and increases in tension, from a given tension, on said cable between said first wheel and the bottom of the body of water.

2. The device of claim 1, wherein: said damper comprises a hydraulic cylinder.

3. The device of claim 1, wherein; said first wheel is mounted for reversible rotation about said second axis.

4. A device for retrieving an ocean bottom seismic cable onto a vessel which has a bow and a stern, comprising a boom arranged to be pivotally mounted at a rear end thereof to the vessel near the bow of the vessel, so that the boom, forwardly of said rear end, is pivotally movable up and down about a generally horizontal axis extending transversely of the boom;

a first wheel mounted on said boom forwardly of said rear end, for rotation about a second axis which extends transversely of the boom;

a second wheel arranged to be mounted on said vessel for rotation about a third axis; said first and second wheels being arranged such that a seismic cable being pulled directly up from the bottom of a body of water on which said vessel is afloat, passes first over said first wheel and second under said second wheel, on its way onto the vessel;

a damper having one end arranged to be mounted to the vessel and having a second end mounted to the boom at a location which is located forwardly of said horizontal axis; said damper being arranged to cause or allow said boom to pivot up and down about said horizontal axis in response to decreases and increases in tension, from a given tension, on said cable between said first wheel and the bottom of the body of water, wherein said first wheel is mounted on said boom for vertical movement with the up and down movement of said boom.

5. A vessel having a bow and a stern and comprising a device for retrieving an ocean bottom seismic cable onto the vessel, said device comprising a boom having a rear end pivotally mounted on said vessel near said bow of the vessel, so that the boom, forwardly of said rear end, is pivotally movable up and down about a first generally horizontal axis extending transversely of said boom;

a first wheel mounted on said boom forwardly of said rear end, for rotation about a second, substantially horizontal, axis which extends transversely of said boom;

a second wheel mounted on said vessel for rotation about a third substantially horizontal axis, said first and second wheels being arranged such that a seismic cable being pulled directly up from the bottom of a body of water on which said vessel is afloat, passes first over said first wheel and second under said second wheel, on its way onto said vessel;

a damper having one end mounted on said vessel and having a second end mounted to said boom at a location which is located forwardly of said first generally horizontal axis, said damper being arranged to cause or allow said boom to pivot up and down about said first horizontal axis in response to decreases and increases in tension, from a given tension, on said cable between said first wheel and the bottom of the body of water.

6. The vessel of claim 5 wherein said first wheel is mounted on said boom for vertical movement with the up and down movement of said boom.

* * * * *